United States Patent [19]

Dunnam, Jr.

[11] 4,443,156

[45] Apr. 17, 1984

[54] AUTOMATIC NATURAL GAS COMPRESSOR CONTROL SYSTEM

[76] Inventor: James A. Dunnam, Jr., 1781 Spy Glass Dr., No. 249, Austin, Tex. 78746

[21] Appl. No.: 233,126

[22] Filed: Feb. 10, 1981

[51] Int. Cl.[3] ..... F04B 49/00

[52] U.S. Cl. ..... 417/12; 417/13; 417/19; 417/20; 417/27; 417/32; 417/63

[58] Field of Search ..... 417/63, 12, 13, 18, 417/19, 32, 33, 26–28, 40, 43, 44, 36, 20; 62/181; 137/206

[56] References Cited

U.S. PATENT DOCUMENTS

| | | | |
|---|---|---|---|
| 1,805,101 | 5/1931 | Modine | 417/243 X |
| 3,091,184 | 5/1963 | Wood | 417/40 |
| 3,390,539 | 7/1968 | Miner | 62/181 X |
| 3,649,446 | 3/1972 | Makela | 137/206 X |
| 4,227,862 | 10/1980 | Andrew et al. | 417/18 X |
| 4,270,884 | 6/1981 | Lintonbon et al. | 417/15 |

*Primary Examiner*—Edward K. Look

*Attorney, Agent, or Firm*—Harvey B. Jacobson

[57] ABSTRACT

A control system for a compressor utilized in transferring natural gas from relatively low pressure wells to a relatively high pressure pipe line incorporating automatic shutdown of the compressor and automatic restart of the compressor in response to certain conditions with the compressor operating at a desired flow rate regardless of upstream fluctuations in pressure. The compressor is unloaded upon shutdown and remains unloaded for a timed duration after startup thereby reducing the required motor size, compressor wear and also eliminating manual startup for most of the usual causes of gas compressor shutdown, such as low well pressure and high discharge line pressure.

9 Claims, 5 Drawing Figures

AUTOMATIC NATURAL GAS COMPRESSOR CONTROL SYSTEM

BACKGROUND OF THE INVENTION

1. Field of the Invention

The present invention generally relates to a compressor control system for use with a compressor associated with a natural gas producing well or wells in which the compressor is automatically shutdown in response to certain conditions, automatically unloaded when shutdown, automatically restarted in response to certain shutdown conditions with re-starting of the compressor including the retention of the compressor in an unloaded condition for a predetermined time interval with the system also including a control for the inlet pressure for maintaining a desired flow rate from the compressor regardless of fluctuations in upstream conditions.

2. Description of the Prior Art

The transfer of natural gas from low pressure wells to high pressure pipelines for delivery to users has presented many problems primarily due to fluctuations in the well pressure and flow rate and fluctuations in pipeline pressure. Compressors have been used for this purpose with the compressors being powered by various types of motors such as electric motors, internal combustion engines, and the like. When such compressors are utilized, it is necessary to provide automatic shutdown features to stop the compressor under certain conditions which, if the compressor continued to operate, would produce adverse and in some instances, dangerous results.

U.S. Pat. No. 3,407,052, issued Oct. 22, 1968 to Huntress et al, discloses a compressor utilized in a natural gas liquefaction system rather than a gas transmission or transfer system and the compressor is not provided with a given flow rate even though the inlet pressure may be variable and does not include an automatic shutdown and unloading and automatic re-start of the compressor in response to inlet or outlet pressures.

U.S. Pat. No. 3,837,377, issued Sept. 24, 1974 to McJones, discloses a system to prevent over-pressurizing a natural gas cylinder and automatically closes a fill line when a predetermined volume is reached in the cylinder which is a different concept from this invention.

U.S. Pat. No. 3,975,115, issued Aug. 17, 1976 to Fisher et al, discloses a pump control system which is pilot operated but does not utilize a control sensitive to inlet or discharge pressure variations and there is no volume control.

U.S. Pat. No. 3,985,467, issued Oct. 12, 1976, to Lefferson, discloses a sensing device to maintain a constant fluid pressure for a variable speed motor which utilizes a feedback network to provide a constant discharge pressure.

U.S. Pat. No. 4,213,476, issued July 22, 1980 to Bresie et al, discloses a compressor having a bypass arrangement which becomes effective when a predetermined maximum discharge pressure is reached. This patent does not have an automatic shutdown and re-start arrangement nor is the compressor unloaded when it is shutdown. This patent also discloses a well control pressure regulating device which is not associated with the compressor.

U.S. Pat. No. 4,218,191, issued Aug. 19, 1980 to Stewart, discloses a compressor having a constant inlet pressure accomplished by a variable speed prime mover with this system being primarily for the purpose of maintaining a low pressure on another system rather than for natural gas transfer or transmission.

SUMMARY OF THE INVENTION

The control system for the natural gas compressor of the present invention utilizes economic electric motors as prime movers and has automatic re-start features for low inlet pressure conditions and high discharge pressure conditions which enables the unit to re-start when a problem in these conditions has been cleared. The unit also has non-re-start protective shutdown features when problems in other conditions occur. The compressor incorporates a self-correcting variable volume flow rate control system that enables the unit to operate at a desired flow rate regardless of upstream "well fluctuations" in pressure. Also, the compressor is unloaded upon shutdown, and remains unloaded for a timed duration after startup thereby minimizing motor size, compressor wear and eliminating manual startup for the most common causes of gas compressor shutdowns, that is, low well pressure and high discharge line pressure.

The control system of the present invention achieves the above results by a combination of several related systems including an inlet pressure sensing system, a volume flow rate control system, a vessel system, a compression system, a cooling system, a mechanical control system, an oil pressure system and an electrical power system.

It is an object of the present invention to provide a control system for automatically controlling the operation of a natural gas compressor which provides gas to the compressor at a substantially fixed rate regardless of upstream well head pressure fluctuations which is obtained by the use of an internal actuated regulator under high pressure conditions and a pilot actuated regulator under low pressure conditions to provide a constant volume discharge and a uniform compressor load regardless of fluctuations in the upstream pressure.

Another object of the invention is to provide a control system which includes an automatic shutdown in response to discharge conditions, automatic unloading of the compressor and automatic re-start of the compressor when the condition which caused the shutdown has been corrected with the unloading of the compressor being maintained for a predetermined time interval after re-start of the compressor, thereby reducing the horsepower requirements for the motor and the motor compressor and eliminating excessive compressor wear and also eliminating the necessity of manually re-starting the compressor under those conditions which are most likely to cause it to shutdown, namely abnormal conditions in the inlet pressure and the discharge pressure.

Still another object of the invention is to provide a control system in accordance with the preceding objects which is economical in installation, efficient and dependable, easily installed and maintained and effective for its intended purposes.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
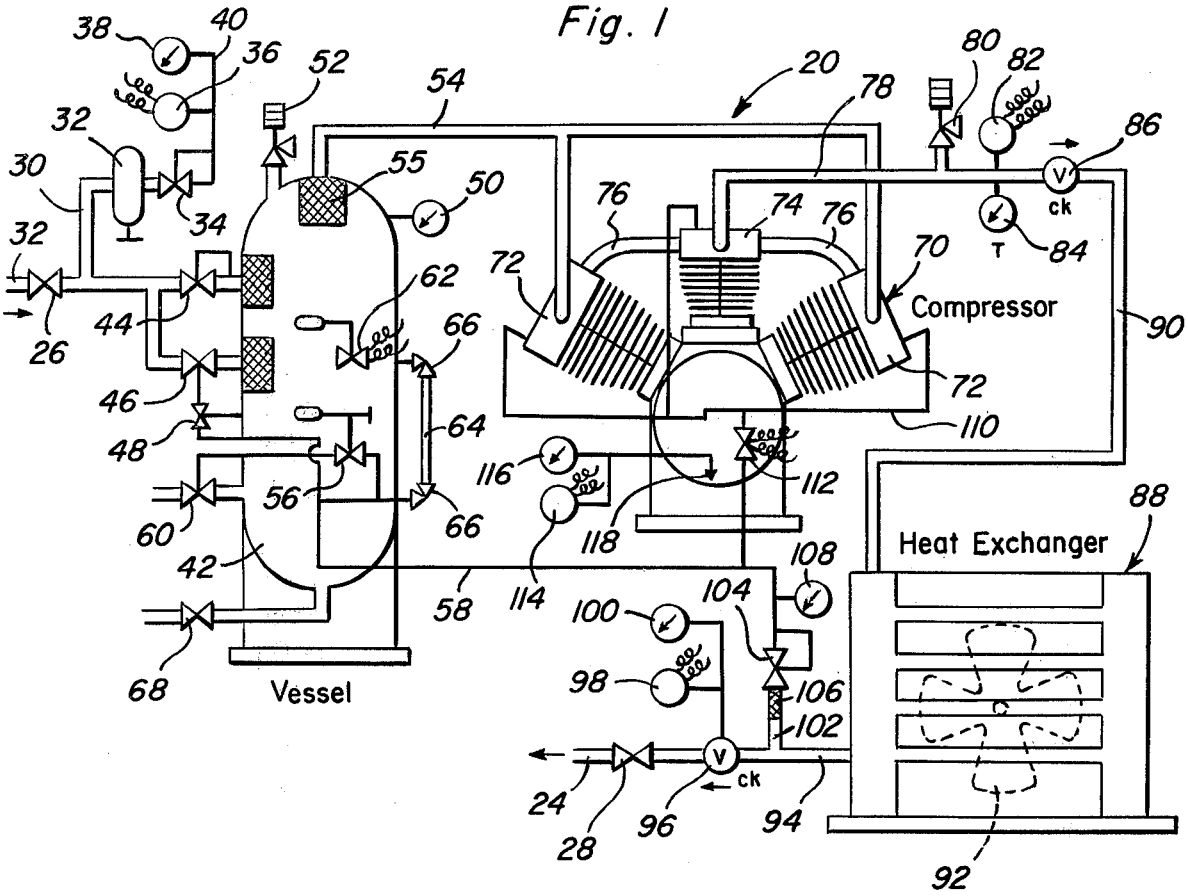
FIG. 1 is a schematic illustration of the control system of the present invention illustrating the orientation and relationship of the components of the system.

Referring now specifically to FIG. 1, the control system of the present invention is generally designated by reference numeral 20 with FIG. 1 schematically illustrating the orientation and relationship of the components of the system for the purpose of transferring natural gas from an inlet pipe 22 connected with a gas well or wells or other source subject to fluctuations in flow rate and pressure and delivering the natural gas at a higher discharge pressure from a pipeline or gas sales line 24 in an efficient, economical and dependable manner.

The inlet pipe 22 includes an isolation valve 26 to completely isolate the control system when desired such as when repairing or replacing components and the like. Also, the discharge pipeline or gas sales line 24 is provided with a similar isolation valve 28 which can be closed when desired thereby enabling the control system 20 to be completely isolated when desired.

The inlet pipe 22 includes a branch pipe 30 having a drip pot 32 incorporated therein when moisture is separated from the gas and collected and drained on a periodic basis. The branch pipe 30 includes a pressure regulator 34 where pressure is reduced for overpressure protection with a inlet pressure switch 36 and an inlet pressure gauge 38 being connected to the regulator by tubing 40. With this arrangement, for example, the regulator 34 could be set at 80 psi for gauge and switch ranges of 0–100 psi with the switch 36 automatically cycling a compressor unit and the gauge 38 monitoring the unit.

A pressure vessel 42 receives natural gas from the inlet pipe 22 through an internal actuated regulator 44 which are commercially available from Rockwell Manufacturing Company, Pittsburgh, Pa. andor a pilot actuated regulator 46 which are commercially available from Kimray, Inc. When the inlet pressure is relatively high, the pressure in the vessel 42 is maintained by the internal actuated regulator 44 and as inlet pressure is drawn down by the compressor, the vessel pressure would also drop. However, pilot actuated regulator 46 senses falling pressure in the scrubber vessel assembly associated with a compressor through pilot 48 and thus opens thereby providing a larger volume flow path for the lower inlet pressure to enter vessel 42 thus maintaining vessel pressure at desired pressure regardless of inlet pressure fluctuation.

The pressure in the vessel 42 is monitored on a pressure gauge 50 and by varying the vessel pressure, the compressor flow rate may be controlled to meet individual customer needs since the flow rate of the compressor is directly proportional to its inlet pressure. The vessel 42 serves not only as a volume chamber but also provides compressor inlet overpressure protection by a safety valve 52 communicated therewith which would relieve excess pressure in the event of the failure of inlet regulators 44 and 46. Also, the pressure vessel 42 provides additional protection from petroleum distillates or other liquids. Although an upstream scrubber is required for gas compressor operation, some liquids frequently are still formed in the inlet lines and in the event that such scrubbers fail, the vessel 42 would act as a separator for the compressor inlet gas. Also, gas enters the pressure vessel 42 from the regulators 44 and 46 and exits the vessel 42 into a suction manifold 54 through baffles and screen mesh assemblies 55.

A pilot float valve 56 senses the liquid level which may exist in pressure vessel 42 and when the liquid level reaches a predetermined level, the pilot float valve 56 opens and sends control pressure from the control pressure line or tubing 58 into dump valve 60, thus opening the dump valve and lowering the liquid level in the vessel 42. Further unit protection is provided against a high level of liquid in the vessel 42 providing a high fluid level float switch 62 in the vessel in order to shut down the unit in the event the incoming fluid rate is greater than the dumping rate or in the event of failure of the dumping valve 60. The vessel 42 is also provided with a sight glass 64, an isolation valve 66 at each end thereof where it communicates with the vessel 42 for monitoring the liquid level in the vessel and also, a drain valve 68 is provided in the bottom of the vessel 42 to enable drainage of liquid from the vessel 42 by manually opening the drain valve 68.

The clean, dry gas exits from the vessel 42 and communicates with the compressor 70 through the suction manifold 54 with the gas being compressed one or two times by first stage and second stage cylinders 72 and 74. If two-stage compression is used, inter-stage cooler 76 is provided for between stage cooling. High pressure gas exits from the last compression cylinder 74 through high pressure discharge line 78 with the high pressure in this line being monitored by high pressure safety valve 80 for overpressure protection and by high temperature switch 82 for high temperature protection with a gauge 84 provided for monitoring the temperature and a check valve 86 downstream therefrom and the high pressure discharge line 78.

The compressed gas passing through the high pressure discharge line 78 enters a heat exchanger 88 through pipe 90 which extends from the check valve 86 to the heat exchanger 88 with the heat exchanger being capable of cooling the compressed gas. A fan 92 may be associated with the heat exchanger for additional cooling in the heat exchanger as needed depending upon seasonal changes in weather conditions or the temperature of ambient air. From the heat exchanger 88, cool, high pressure gas exits through discharge pipe 94, through check valve 96 and the isolation valve 28. Overpressure protection is provided for the discharge pipe 94 by the use of a discharge pressure switch 98 communicated with the discharge pipe 94 and the discharge pressure is monitored by gauge 100. Also, compressed gas exiting the heat exchanger 88 through line 94 passes into a branch pipe 102 and enters a control system regulator 104 through a screen or mesh material 106. The system pressure is controlled and monitored by the control regulator 104 and pressure gauge 108 with the tubing 58 being communicated with the regulator 104 and receiving control pressure therefrom. The dry low pressure gas is sent to compressor unloaders housed in the cylinders 72 and 74 through tubing 110 which is communicated with the tubing 58 through a solenoid valve 112 which opens on compressor shutdown with the tubing 110 extending to each of the cylinders 72 and 74 to operate the unloaders in each of the cylinders. Also, control gas pressure is provided through the tubing 58 to operate the pilot actuated regulator valve 46 and the vessel dump valve 60 through their respective pilots 48 and 56.

The compressor 70 is provided with a lubrication system which may be either a pressurized flow lubrication system, a splash system or a drip system, or any combination of these, with there being protection to shut down the unit in the event of inadequate lubrication pressure. For this purpose, a low lubricating oil pressure switch 114 and gauge 116 communicates with and monitors the oil pressure at the oil pump discharge 118 with suitable tubing for such communication. Thus, if inadequate lube oil is provided or if the lube oil pump produces inadequate oil pressure for any reason, the low oil pressure switch 114 will shut down the unit.

Figure 2:
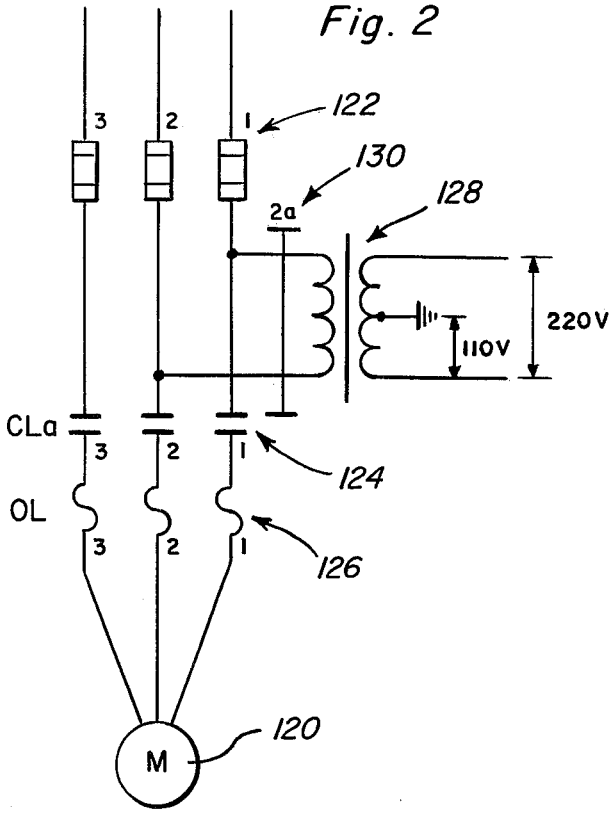
FIG. 2 is a diagrammatic illustration of the power supply circuit for the compressor motor.

FIG. 2 illustrates the power source for the compressor motor 120. The system may be powered from 480 volts or 220 volts, AC, three phase or single phase to be used in conjunction with a phase converter. Inasmuch as 480 volt three phase power is most commonly used, this system is disclosed in FIGS. 2–5. Incoming power to compressor motor 120 passes through the usual fuses (1, 2, 3) 122, starter contacts (1, 2, 3) 124 and thermal strips (1, 2, 3) 126. With the fuses and thermal stips installed, closing starter contacts will complete the circuit to run the motor with control of the starter contacts being described later with regard to the illustration in FIGS. 4 and 5. Also, 480 voltage is provided to a power transformer 128 through circuit breaker 130 to provide 220 volts to the fan circuit illustrated in FIG. 3 and to provide 110-volts to the control circuit illustrated in FIG. 4.

Figure 3:
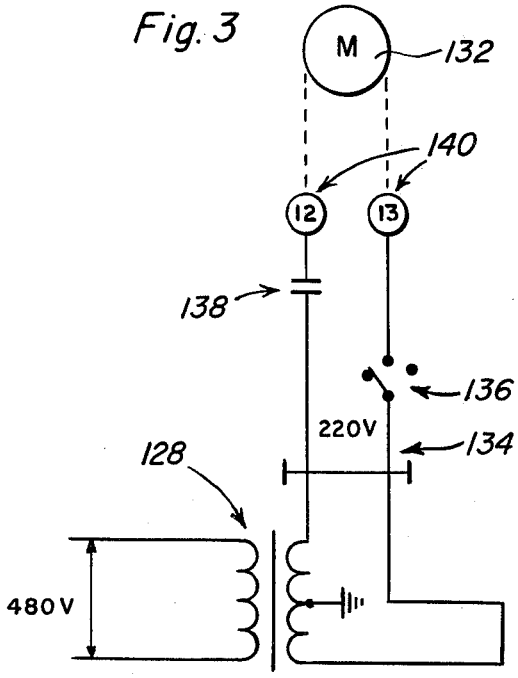
FIG. 3 is a diagrammatic view of the power circuit for the fan motor associated with the heat exchanger.

FIG. 3 illustrates the power source for the fan motor 132 in which 220 volts is supplied from the power transformer 128 through a circuit breaker 134, switch 136, auxiliary starter contacts 138 and terminals (12 and 13) 140. With the circuit breaker 134 closed and the fan switch 136 on, the fan motor 132 will be energized as the contact 138 will be closed as described in connection with FIG. 4. With this arrangement, the unit may be operated with or without power supplied to the heat exchanger fan motor depending upon weather conditions, seasonal conditions, and ambient air conditions and the like thereby enabling lower power usage than if the fan operated whenever the unit was in operation.

Figure 4:
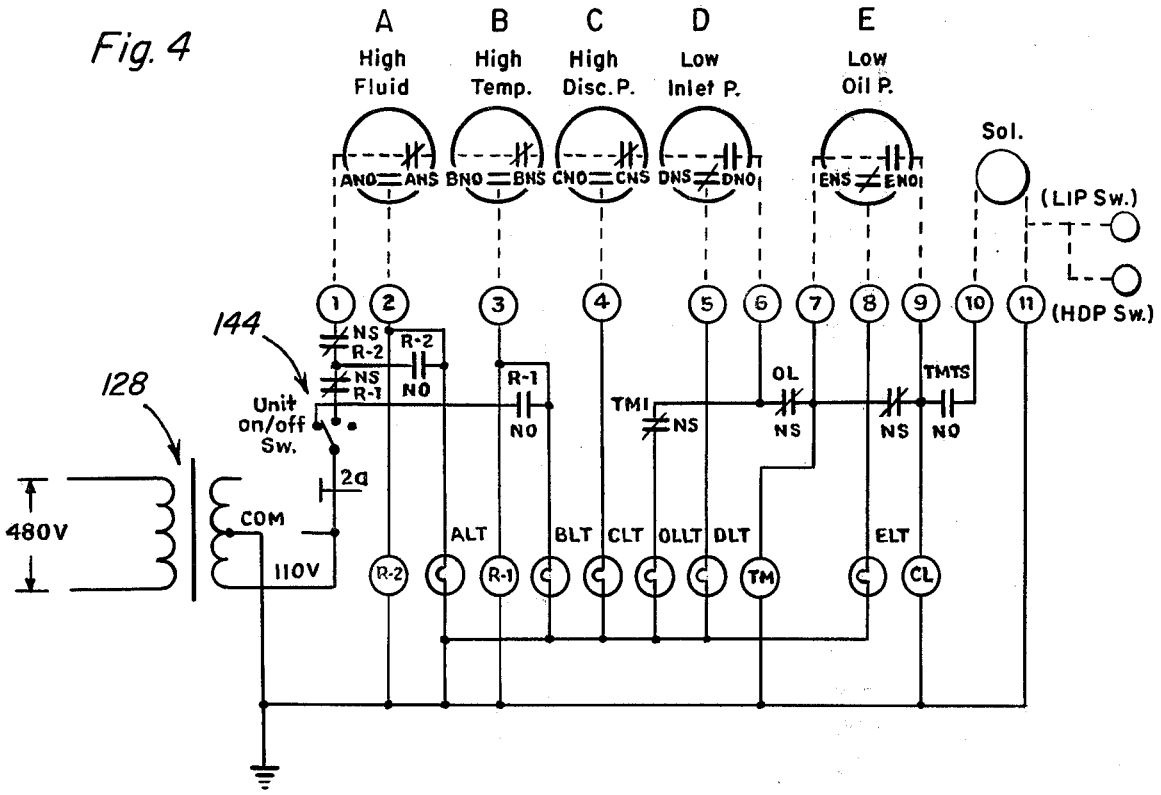
FIG. 4 is a diagrammatic view of the circuit for supplying power to the control circuit.

FIG. 4 illustrates the 110-volt control circuit which receives 110 voltage from the transformer 128 with the unit being started by energizing coil (CL) which close the starter contacts (1, 2, 3) 124. The power to energize coil (CL) is received from the circuit breaker (*2a*), unit on/off switch 144, contacts (R-1, NS and R-2, NS), terminal (1), high fluid switch contacts (ANS), high temperature contacts (BNS), high discharge pressure switch contacts (CNS), and with pressure at inlet, low inlet pressure switch contacts (DNO), overload switch contacts (OLNS) and timer contacts (TMTO NS). When unit is started, oil pressure will build up shutting low oil pressure switch contacts (ENO) and timer (TM) will time out after a specified duration thus opening contacts (TMTONS) and shutting contacts (TMTSNO). Thus, the unit is now "loaded" from energizing solenoid (SOL) and in lube oil protection mode from lube oil switch.

The automatic switching provides that the unit may be shut down on a safety requirement and re-started automatically when condition clears with no operator manual assistance. Assuming that the unit is running and the circuitry is as described above, the coil (CL) is energized through switches A, B, C, D, OL, E and the unit is loaded with solenoid (SOL) energized. Assuming that the low inlet pressure switch (D) is set to start unit at 60 psi, shutdown unit at 20 psi inlet pressure and that high pressure discharge switch (C) is set to shut down unit at 300 psi and start unit at 250 psi, with the unit running and when the inlet pressure drops to 20 psi, low inlet pressure switch (D), contacts (DNO) open, and (DNS) shut causing unit to shut down; become unloaded as solenoid (SOL) is also deenergized; and low inlet pressure light (DLT) is illuminated. When inlet pressure rises to 60 psi, contacts (DNO) shut, (DNS) open and unit starts up, remains unloaded and light (DLT) is extinguished. After timer runs out, unit goes into oil protection mode and loads up. The high discharge sequence is identical except that switch senses discharge line pressure and the switch set points are of different values. Safety switching is also provided for various protective features which will shut unit down, illuminate a trouble light and keep unit shut down for investigation and/or repair prior to a manual startup. High discharge temperature switch (B) will shut down unit if temperature set point is exceed by contacts (BNS) opening and (BNO) shutting thus causing coil (CL) to be deenergized, causing light (BLT) to be illuminated and also relay (R-1) is energized for opening contacts (R-INS) and closing (R-1 NO) which will maintain unit shutdown with trouble light on. High fluid levels switch (A) works in an identical manner to the high discharge temperature circuitry except that it senses the fluid level or liquid level in vessel 42.

Overload reset switch provides protection by thermal strips (1, 2, 3) 126 sensing current overload causing contacts (OLNS) to open and power to be secured to coil (CL) thus deenergizing the coil and shutting the unit down with timer (TM) deenergized leaving the unit unloaded, and light (OLLT) energized by the instantaneous timer contacts (TMI NS). The unit will remain shut down with light on until operator arrives to investigate/repair and re-start unit.

Low oil pressure switch (E) gives compressor protection against oil failure to the bearings by monitoring the pressure at the oil pump discharge. If oil pressure falls to switch set point, contacts (ENO) open, (ENS) shut, causing coil (CL) and solenoid (SOL) to deenergize shutting down unit and unloading the unit with trouble light (ELT) on with the unit remaining shut down until an operator repairs the problem and re-starts the unit.

Figure 5:
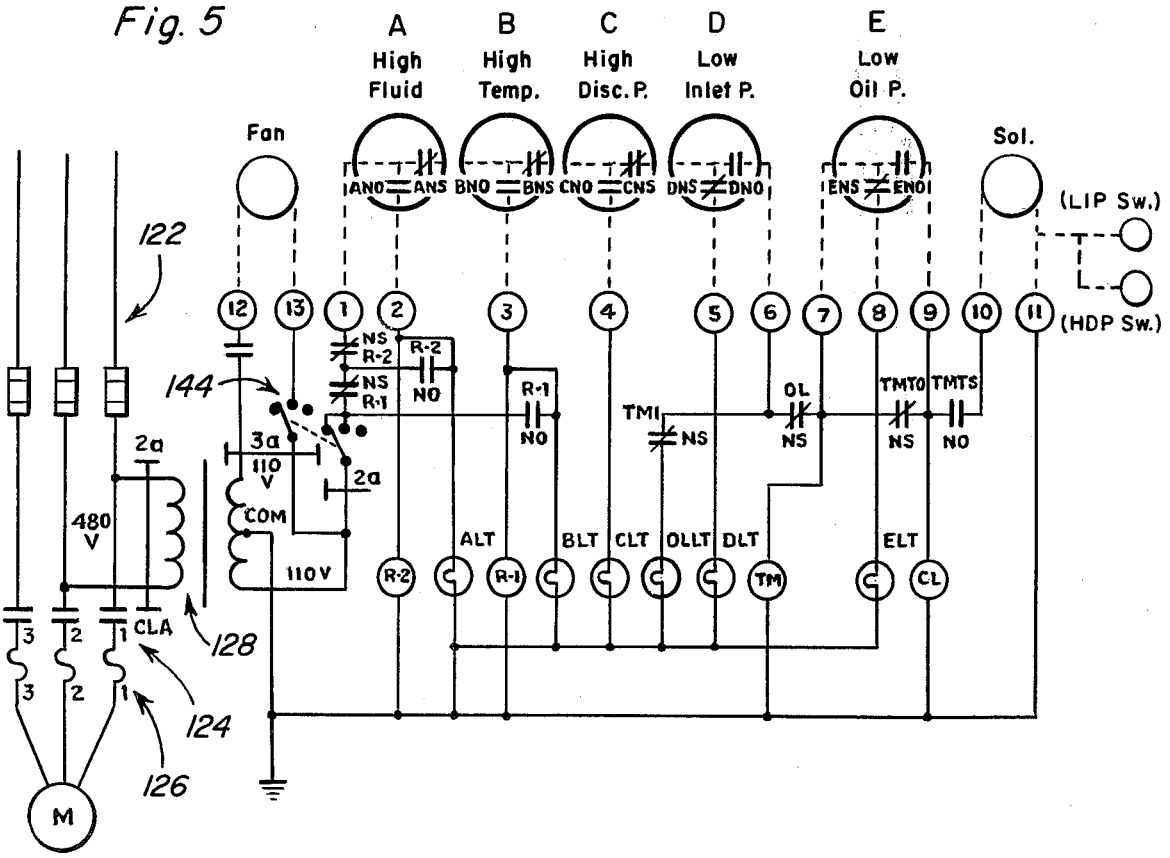
FIG. 5 is a diagrammatic view illustrating the association of all of the circuits illustrated individually in FIGS. 2, 3 and 4.

FIG. 5 illustrates the complete circuit for the control system with the integrated circuit including an on/off switch 144 which enables the unit to be switched on with or without power to the cooler fan motor 132, thus enabling selective operation of the fan motor.

With this system, the gas is provided to the compressor at a substantially fixed rate regardless of upstream well head pressure which provides constant volume pumping and a uniform compressor load regardless of upstream pressure fluctuations enabling the use of lower horsepower motors that could not be used if the compressor had fluctuations in inlet pressure and thus fluctuations in load. This lowers energy use and also makes possible the use of a variety of standard compressors which have sufficient rod strength to accept inlet pressures above atmospheric. This arrangement, in many cases, enables a marginal gas well to be produced which would be economically unfeasible with higher cost, special compressors and high energy use. The automatic unloading of valves and relieving of pressure when the compressor shuts down will reduce horsepower requirement for startup and makes possible the use of lower horsepower motors to reduce the cost of the installation and save energy. The electrical system of automatic shutdown and re-starting in response to inlet pressure and discharge pressure does not interfere with the other shut-down features which require the services of maintenance personnel. However, since most compressor shutdowns are in response to inlet pressure conditions or discharge pressure conditions, the majority of the shutdown conditions will not require maintenance personnel since the conpressor will automatically re-start when the shutdown conditions correct themselves. The electrical control system utilizes a standard electromagnetic contact system to start and stop the electric motor drive with the control system energizing the starter coil when all switches are within correct ranges with the discharge pressure switch and well head inlet pressure switch providing for automatic restarting. The control of the inlet pressure coupled with the unloader system provides efficient energy use and lower horsepower requirements and eliminates the need for clutch mechanisms or manual unloading to start the compressor thereby providing efficient automatic pumping of natural gas. Existing arrangements which require manual re-starting are not efficient in operation since considerable down time of the compressor occurs while maintenance personnel go to the site of the compressor to re-start the same whereas in the system, when certain conditions correct themselves such as a high discharge pressure being reduced, or low inlet pressure increasing the system will automatically re-start the compressor thereby reducing the down time of the compressor to a minimum.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A control system for a compressor utilized for transferring natural gas from a producing well or other source at a relatively low pressure to a discharge pipe for transmission to users at a relatively high pressure, said system comprising a compressor having drive means connected thereto, inlet means connected with the compressor for suppling low pressure natural gas thereto, discharge means connected with the compressor for discharge of high pressure gas therefrom, sensing means in the inlet means to maintain a substantially constant gas flow to the compressor regardless of gas pressure fluctuations from the gas source and to shut down the compressor in response to abnormal inlet conditions and automatically re-start the compressor when such abnormal conditions correct themselves, said discharge means including sensing means to control the rate of supply of gas to the compressor and shut down the compressor in response to abnormal conditions in the discharge means and automatically re-start the compressor when the abnormal conditions correct themselves thereby minimizing down time of the compressor by automatically re-starting the compressor when abnormal conditions which shut down the compressor correct themselves without manual re-starting of the compressor.

2. The system as defined in claim 1 wherein said sensing means which shuts down the compressor includes means for unloading the compressor and maintaining it unloaded when automatically re-started for a predetermined period of time thereby reducing the power requirements of the drive means for the compressor since the compressor will be re-started while unloaded.

3. The system as defined in claim 2 wherein said sensing means associated with the inlet means includes a pressure vessel communicated with the source of natural gas through an internally actuated regulator and a pilot actuated regulator with the pilot actuated regulator being responsive to gas pressure in the discharge means of the compressor thereby controlling the rate of flow of gas to the compressor in response to the discharge means pressure.

4. The system as defined in claim 1 together with additional sensing means to shut down the compressor in response to high discharge temperature.

5. The system as defined in claim 1 together with additional sensing means to shut down the compressor in response to inadequate lubrication of the compressor.

6. The system as defined in claim 1 together with a heat exchanger and fan for cooling high pressure discharge gases, and a control circuit to enable operation of the compressor with and without operation of the fan.

7. The system as defined in claim 1 wherein said vessel includes a manual drain valve and an automatic dump valve operated in response to liquid reaching a predetermined elevation in the vessel.

8. The system as defined in claim 1 together with liquid level sensing means in the vessel to shut down the compressor when liquid level in the vessel reaches an unsafe elevation.

9. The system as defined in claim 3 together with a control circuit for automatically re-starting the compressor when abnormal inlet or outlet pressures correct themselves.

* * * * *